343-909 SR
4/12/88 XR 4,737,796

United States Patent [19]
Bonebright et al.

[11] Patent Number: 4,737,796
[45] Date of Patent: Apr. 12, 1988

[54] GROUND PLANE INTERFERENCE ELIMINATION BY PASSIVE ELEMENT

[75] Inventors: Mark E. Bonebright; Derling G. Killion, both of San Diego, Calif.

[73] Assignee: The United States of America as represented by the Administrator of the National Aeronautics and Space Administration, Washington, D.C.

[21] Appl. No.: 890,586

[22] Filed: Jul. 30, 1986

[51] Int. Cl.[4] ..... H01Q 19/14
[52] U.S. Cl. ..... 343/782; 343/909; 343/910
[58] Field of Search ..... 343/782, 909, 910, 911

[56] References Cited

U.S. PATENT DOCUMENTS

| | | | |
|---|---|---|---|
| 2,640,154 | 5/1953 | Kock | 343/910 |
| 2,703,842 | 3/1955 | Lewis | 250/33.65 |
| 2,763,001 | 9/1956 | Bussey | 343/841 |
| 3,144,606 | 8/1964 | Adams et al. | 343/910 |
| 3,156,917 | 11/1964 | Parmeggiani | 343/782 |
| 3,495,265 | 2/1970 | Smith | 343/911 |
| 4,321,604 | 3/1982 | Ajioka | 343/753 |
| 4,342,033 | 7/1982 | De Camargo | 343/909 |
| 4,467,329 | 8/1984 | Thal, Jr. | 343/909 |
| 4,503,436 | 3/1985 | Cramer | 343/876 |

*Primary Examiner*—William L. Sikes
*Assistant Examiner*—Hoanganh Le
*Attorney, Agent, or Firm*—Paul F. McCaul; John R. Manning; Thomas H. Jones

[57] ABSTRACT

The radiation pattern of a beam at elevation angles near the horizon is improved for phased array antennas by control of the radiation field intensity near the horizon to reduce multipath disturbances, and to improve the axial ratio of a circularly polarized phased array antenna. This is accomplished by placing a parasitic phase shifting element directly below the antenna beam axis. The waveguide section is designed to produce a phase shift in the portion of antenna radiation energy passing through it to cancel some of the radiation energy in the direction of the horizon. The spacing of the waveguide section in front of the antenna is determined empirically for optimum results, i.e., for reduction of beam power below about 20° without affecting beam power at high elevation angles.

9 Claims, 2 Drawing Sheets

GROUND PLANE INTERFERENCE ELIMINATION BY PASSIVE ELEMENT

ORIGIN OF INVENTION

The invention described herein was made in the performance of work under a NASA contract, and is subject to the provisions of Public Law 96-517 (35 USC 202) in which the Contractor has elected not to retain title.

BACKGROUND OF THE INVENTION

The invention relates to a method and apparatus for controlling the radiation field intensity at low elevation angles for a phased array antenna, such as for mobile telephones in a satellite link system of communication, by control of the radiation pattern near the horizon of a phased array antenna, and more particularly for eliminating interference by reflected radiation from the surrounding terrain.

A mobile telephone system may utilize a geostationary satellite as a link between two points on earth that are too far apart for direct communication, or out of range of other systems now in place on earth. A satellite can relay large numbers of telephone communication signals between mobile units located within a wide area, such as the continental United States, using only a moderate bandwidth for communication.

At the mobile unit on the earth, a phased array antenna is mounted on top of a vehicle with the antenna tilted to produce a beam axis at an optimum elevation angle, typically ~40° for the central part of the United States. The antenna array is rotated to the optimum azimuth angle, either by rotation on the vehicle, or by reorientation of the vehicle on the ground. In either case, reflections from the surrounding terrain produce multipath disturbances. An object of this invention is to control the radiation intensity in the direction of the reflected radiation, thereby to reduce multipath disturbance or interference with the optimum antenna radiation pattern of the mobile unit.

Methods employed for control of the radiation pattern near the ground have involved using inductive gratings or absorbers. However, limitations in materials, size restrictions, and other technical objections require a new approach to eliminate multipath disturbances, and to maintain good circularly polarized axial ratios at low elevation angles. In the past, achieving good circularly polarized beams at low elevation angles has been extremely difficult.

SUMMARY OF THE INVENTION

In accordance with this invention, a dual polarized and passive phase shifting element is positioned in front of an antenna array to cause reduction of the antenna radiation pattern in the direction of the horizon where multipath radiation creates a disturbance. The phase shifting element is positioned to intercept and reradiate a substantial portion of the ground reflected energy. The parameters of the phase shifting element are selected to provide the desired cancellation. This phase shifting element not only reduces multipath disturbances, but also improves the axial ratio of a circularly polarized antenna.

A preferred phase shifting element is a waveguide section the axial ratio a/b of which is selected to be $\lambda/2$ and the length of which is selected to optimize the pattern falloff below ~20° in elevation while not drastically effecting the gain at and above ~20° in elevation. The difference in phase velocity of wave propagation through the waveguide will so shift the phase of reradiated energy relative to the wave propagation around the waveguide that at the far end (exit) of the waveguide the propagated waves combine out of phase, thus reducing the power of the radiation pattern at low elevation angles in the direction of the horizon. In particular, for a mobile telephone antenna having its beam axis at ~40° elevation, a requirement for antenna pattern falloff for radiation below ~20° in elevation is satisfied by a single section of waveguide placed within the near field of the antenna. This also provides an improvement in axial ratio of a circularly polarized beam, i.e., improvement in circularity of the beam, at low elevation angles.

DESCRIPTION OF PREFERRED EMBODIMENTS

A geostationary satellite communication system utilizes a satellite transceiver to receive and retransmit microwave communication signals from and to any selected location on Earth within a predetermined area, such as the continental United States. The satellite is designed to selectively transmit and receive narrow beams of a 3 dB beam width of about 0.44 degrees, as described in U.S. Pat. No. 4,503,436, so that each beam covers a segment of the continental United States a few hundred miles in diameter. This allows the same frequency band (nominally 850 MHz) to be utilized in a large number of different sections of the United States. This minimizes the frequency band required to provide the required communications capacity over the entire United States.

Figure 1:
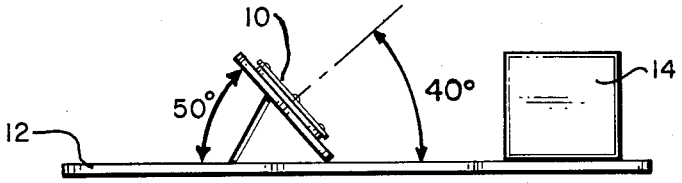
FIG. 1 is a side view of a 1×4 phased array antenna and a phase shifting element on a ground plane.

What is important to this invention is that the elevation angle of the communications satellite may be as great as ~60° in the southern United States and as small as ~20° in the northern United States. This is because the satellite is stationary over the equator. Assuming an elevation angle of 40° of the beam axis from a mobile receiving antenna 10 to the satellite, as shown in FIG. 1, it can be readily appreciated that a 1×4 array of antenna patch elements, tilted 50° from the horizontal to have a beam axis optimally at an elevation angle of 40°, will have interference due to radiation reflected from the ground in the direction of the horizon which will interfere with the direct radiation between the ground unit and the satellite. The ground which reflects energy, and thus creates multipath disturbances, is the terrain surrounding a ground plane 12. In practice, that ground plane will be the top of the vehicle on which the mobile receiver antenna is mounted, but in other applications there may be no ground plane a such.

A multipath antenna response will suffer from disturbances in the received signal, and the disturbances may produce intolerable distortions, particularly for weak signals. To eliminate the multipath disturbances, a passive, dual polarized, phase shifting element 14 is placed on the ground plane 12 within the near field in front of the antenna array. This element takes a portion of the radiation reflected by the surrounding terrain, and shifts its phase about 180° so that upon emerging from the phase shifting element, the reflected radiation combines with reflected radiation passing around and over the element to so cancel some of the reflected radiation as to reduce the antenna power at elevations of less than 20°.

Figure 2:
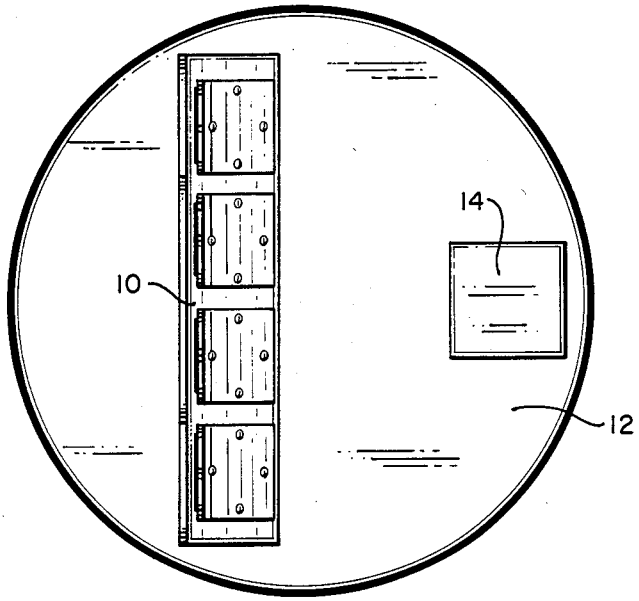
FIG. 2 is a plan view of the phased array antenna and a dual polarized phase shifting element.
Figure 3A:
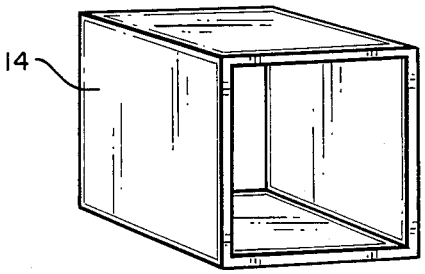
FIG. 3*a* is an isometric view of one embodiment of the phase shifting element comprised of a square waveguide section.
Figure 3B:
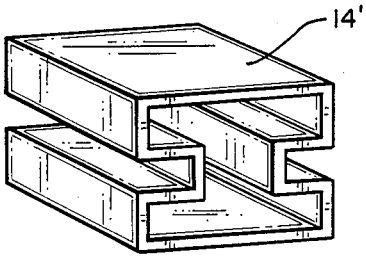
FIG. 3*b* is an isometric view of a second embodiment of the phase shifting element comprised of a ridge waveguide section.
Figure 4:
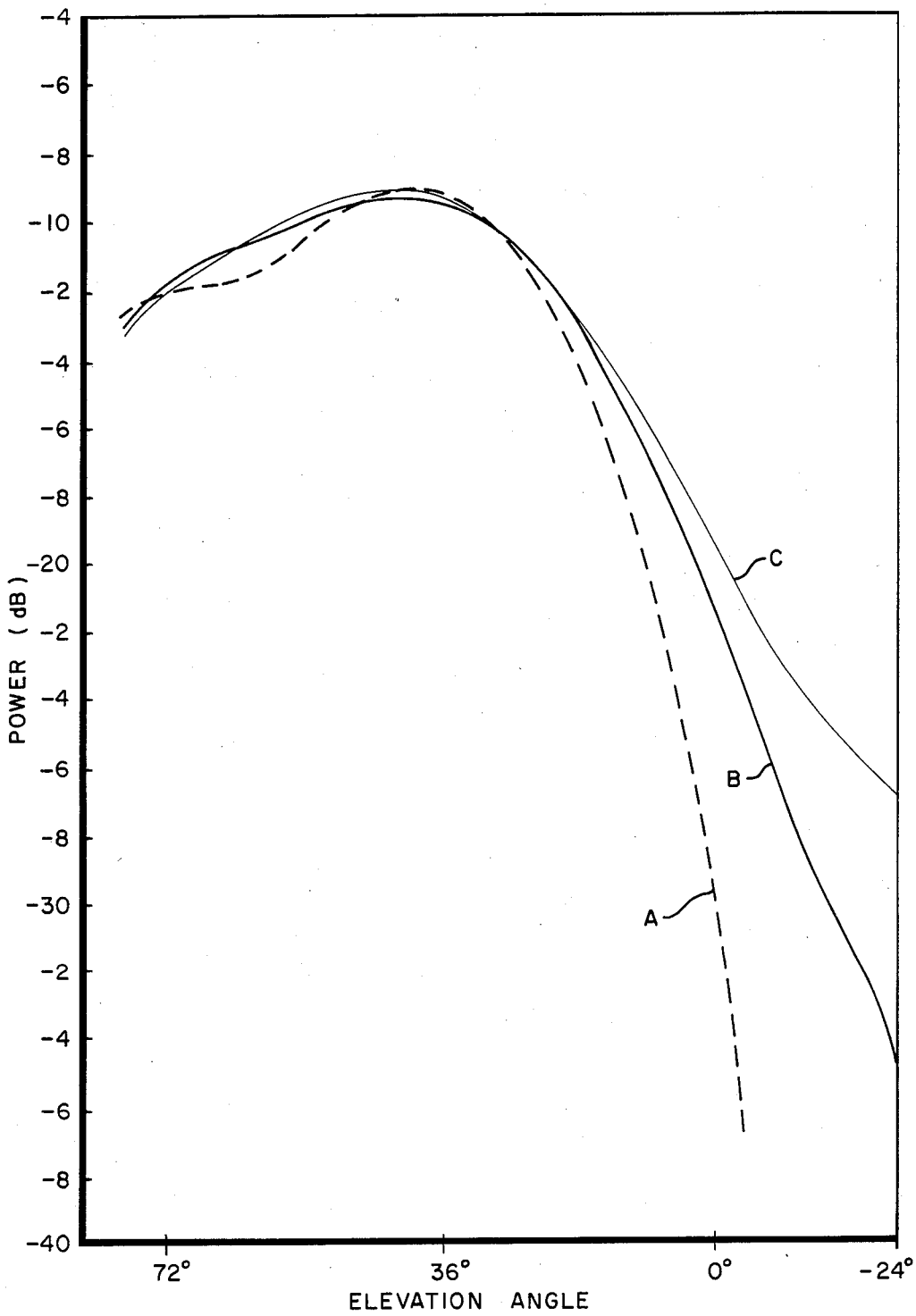
FIG. 4 is a graph of the phase array antenna pattern for the conditions of (A) a square waveguide section, (B) a ridge waveguide section, and (C) no waveguide section on the ground plane in front of the array antenna.

The technique has been successfully tested using the 1×4 patch array antenna shown schematically in FIG. 2 with a passive phase shifting element 14 as illustrated in both FIGS. 3*a* and 3*b*. The element of FIG. 3*a* is a square waveguide section designed for a frequency of 850 MHz. The element of FIG. 3*b* is a ridge waveguide section also designed for a frequency of 850 MHz. The radiation patterns for the antenna array with the phase shifting elements of FIGS. 3*a* and 3*b* are shown in FIG. 4 by the rectangular coordinate curves A and B of power versus elevation angle for comparison with a curve C obtained from the array operating with no phase shifting element in front of it.

As can be seen from the data in the graph of FIG. 4, there is a decrease in antenna power below 20° in elevation, and the decrease is greater for the square waveguide section (graph A) than for the ridge waveguide section (graph B). This shows the drop off in radiation pattern below 20° elevation can be improved over that with no waveguide section (graph C) by up to 10 dB.

The effect of the waveguide section was also found to improve the axial ratio of the antenna pattern, i.e., to improve the circular polarization of the antenna beam at low elevation angles by attenuation of some of the vertically polarized energy. Excellent axial ratios have been obtained for circular polarized beams down to and below the level of the ground plane 12. Prior to this development good circularity was extremely difficult to achieve at low elevation angles.

The dimensions of the waveguide sections in FIGS. 3*a* and 3*b* are closely related to the wavelength for the operating frequency, nominally 850 MHz in this example, but the actual frequency may be between 821 and 876 MHz. With a wavelength for the frequency of 850 MHz, the height and width dimensions given for the shapes shown in FIGS. 3*a* and 3*b* will provide good results for the range of 821 to 876 MHz. The length of the waveguide section was empirically selected to provide about 180° phase shift at the nominal operating frequency of 850 MHz. That length was found to be about eight inches. While it would be possible to compute theoretically the length required, it was found to be more practical to do so empirically, using inexpensive material that is easy to work with, like aluminum. This empirical approach avoids the necessity of determining the input and output coupling impedances in order to compute the length theoretically. Also other shapes or types of phase shifting elements may be empirically selected; all that is really important is that its phase shift produced by the element be sufficient to provide a reduction in gain below about 20° in elevation without affecting the antenna power at higher elevation angles.

FIG. 4 shows that, for a square waveguide section (curve A), the antenna gain is affected at higher elevation angles, as evidenced by the dip in the graph A between 48° and 72°. However, it was found that this dip may be eliminated by adjusting the actual distance of the waveguide section from the antenna to an optimum position determined empirically. It is possible that an adjustment in length of the square waveguide section, instead of, or in addition to, an adjustment of its position, will eliminate this dip in power at high elevation angles.

Although particular embodiments of the invention have been described and illustrated herein, it is recognized that modifications and variations may readily occur to those skilled in the art. For example, in some applications the passive phase shifting element may be positioned in front of the antenna without the use of a ground plane to support it, such as by use of a dielectric support. Also, any change in the environment may have some affect in the resulting antenna radiation pattern which may require modification of the phase shifting element and/or the position of the phase shifting element for the desired control of radiation at low elevation angles below ~20°. Consequently, it is intended that the claims be interpreted to cover such modifications and variations.

What is claimed is:

1. In a system utilizing a phased array antenna on the ground for communication with a satellite, a method of reducing multipath disturbances in the beam of said antenna due to ground reflections comprising the steps of intercepting in a waveguide section a portion of the energy radiated by said antenna in the direction of the ground, and reradiating it out of phase with the portion of energy not intercepted, thereby decreasing the antenna power at low elevation angles where interfering multipath radiation of said antenna occurs.

2. A method as defined in claim 1 wherein the elevation angle of said satellite is between about 20° and 60° for all antenna positions of interest, and the elevation angle of said antenna beam is about 40°, and the energy intercepted at low elevation angles near the horizon is directly under the axis of said antenna beam.

3. A system for communication with a satellite utilizing a circulating polarized phased array antenna on the ground, a method of improving the axial ratio of said circularly polarized antenna at elevation angles near the horizon comprising the steps of intercepting in a waveguide section a portion of the energy radiated in the direction of the horizon, and reradiating it out of phase with the portion of energy not intercepted, thereby reducing the antenna power in the direction of the horizon to improve the axial ratio of the circularly polarized antenna.

4. In a mobile radio communication system utilizing a geostationary satellite link and a phased array antenna mounted on a mobile ground plane, means for reducing multipath disturbances due to surrounding ground reflections from said antenna having a beam with its axis at an elevation angle between 20° and 60°, comprising a waveguide section having its axis positioned directly below said antenna beam axis on said ground plane within the near field of said antenna for intercepting some of that portion of said beam energy that is radiated in the direction of the horizon and reradiating it with a phase shift sufficient for partial cancellation of a portion of said beam energy that is radiated in the direction of the horizon and not intercepted by said phase shifting means, thereby to decrease the antenna power at low elevation angles in the direction of the horizon.

5. Apparatus as defined in claim 4 wherein said section is of a square waveguide having a width and height $\lambda/2$ and a length selected to provide a reduction in gain below $\sim 20°$ in elevation without affecting the antenna gain at higher elevation angles.

6. Apparatus as defined in claim 4 wherein said waveguide section is a ridged waveguide section having a width $\lambda/2$ on unridged sides, and a height of $0.75\lambda/2$ width on the ridged sides, and a length selected to provide a reduction in antenna power below $\sim 20°$ in elevation without affecting the antenna power at higher elevations.

7. In a radio communication system utilizing a satellite link and a phased array circularly polarized antenna on the ground, means for improving the ratio of the vertical to the horizontal axis of a circularly polarized antenna beam at elevation angles near the horizon comprising a waveguide section having its axis positioned directly below said antenna beam axis, and within the near field of said antenna, for intercepting a portion of the energy radiated in the direction of the ground and reradiating it with a phase shift for partial cancellation of the portion of energy not intercepted by said phase shifting means, thereby to decrease the antenna power at low elevation angles and improve the axial ratio of said circularly polarized antenna.

8. Apparatus as defined in claim 7 wherein said section is of a square waveguide having a width and height $\lambda/2$ and its length is selected to provide a reduction in power below $\sim 20°$ in elevation without affecting the antenna power at higher elevation angles.

9. Apparatus as defined in claim 7 wherein said waveguide section is a ridged waveguide section having a width $\lambda/2$ on unridged sides, and a height of $0.75\lambda/2$ on the ridged sides, and its length is selected to provide a reduction in power below $\sim 20°$ in elevation without affecting the antenna power at higher elevations.

* * * * *